United States Patent [19]

Kawagishi et al.

[11] Patent Number: 4,656,112

[45] Date of Patent: Apr. 7, 1987

[54] TONER FOR DEVELOPING ELECTROSTATIC LATENT IMAGES

[75] Inventors: Yoji Kawagishi, Yawata; Shinichi Narita, Kawachinagano; Takashi Kiriu, Osaka; Kenji Uomoto, Takatsuki, all of Japan

[73] Assignee: Orient Chemical Industries, Ltd., Japan

[21] Appl. No.: 775,485

[22] Filed: Sep. 12, 1985

[30] Foreign Application Priority Data

Sep. 12, 1984 [JP] Japan ..... 59-191117

[51] Int. Cl.[4] ..... G03G 9/08

[52] U.S. Cl. ..... 430/110

[58] Field of Search ..... 430/110, 106

[56] References Cited

U.S. PATENT DOCUMENTS 4,535,048 8/1985 Inoue et al. ..... 430/110

4,563,409 1/1986 Suzuki et al. ..... 430/110

*Primary Examiner*—John L. Goodrow

*Attorney, Agent, or Firm*—McGlew and Tuttle

[57] ABSTRACT

A toner for developing electrostatic latent images which is characterized in that the toner comprises as a charge control agent a zinc complex compound of an aromatic hydroxycarboxylic acid having or not having a substitutent.

13 Claims, No Drawings

TONER FOR DEVELOPING ELECTROSTATIC LATENT IMAGES

The present invention relates to a novel negatively chargeable toner of the dry type for developing electrostatic latent images in electrophotography, electrostatic recording, electrostatic printing, etc.

Electrostatic latent images can be developed into visible images with a toner which is caused to adhere to the image by electrostatic attraction. Besides liquid developers, powder developers are widely used for developing electrostatic latent images.

The powder developers are divided generally into two types: two-component developers comprising a toner having a mean particle size of 15 μm and a carrier of finely divided iron or ferrite mixed with the toner and 100 to 200 μm in particle size, the toner being composed of a natural resin or synthetic resin and a coloring agent, charge control agent, fluidizing agent, etc. dispersed in the resin; and one-component developers comprising a natural resin or synthetic resin, and a coloring agent, charge control agent, fluidizing agent and magnetic material which are dispersed in the resin.

With the two-component developer, the toner is triboelectrically charged by the carrier and deposited on electrostatic images for development. The one-component developers heretofore known include toners which are chargeable by friction with a brush- or plate-like friction member serving the function of the carrier as a substitute therefor. Also made known in recent years is a toner which is chargeable by friction with a finely divided magnetic material which is maintained in a dispersed state. These developing toners are held positively or negatively charged in accordance with the polarity of the electrostatic latent image to be developed.

In order to hold the toner charged, it has been proposed to make use of the triboelectric properties of the resin which is the main component of the toner. With this method, however, the toner is given only a small amount of charge, has great solid surface resistance and therefore produces toner images which are prone to fogging and indistinct. Accordingly, to impart the desired triboelectric chargeability to the toner, dyes and pigments for giving charges and further charge control agents are admixed with toners. Such agents presently used in the art include oil-soluble Nigrosine dyes, etc. for giving positive charges to the toner as disclosed in Published Examined Japanese Patent Application No. SHO 41-2427, and metal-containing complex salt dyes, etc. disclosed in Published Examined Japanese Patent Application No. SHO 45-26478, etc. and adapted to give negative charges to the toner.

Nevertheless, these dyes and pigments as charge control agents are complex in structure and low in stability. They are susceptible to decomposition or degradation to lose charge control properties, owing for example to mechanical friction and impact, changes of temperature and humidity, electrical impact, irradiation with light, etc. Further one of their substantial defects is that these agents are colored substances and are therefore in conflict with the requirement that a colorless or substantially colorless charge control agent should be used for a toner having a particular color.

Although Published Unexamined Japanese Patent Application Nos. SHO 53-127726, SHO 57-104940, SHO 57-111541, SHO 57-124357, etc. disclose various complex compounds which meet this requirement, these compounds still invariably have some slight color.

We have carried out intensive research on compounds which remain thermally stable up to a temperature permitting thorough melting and kneading and which are colorless and capable of giving negative charges to toners, and found that zinc complex compounds of aromatic hydroxycarboxylic acids which may have a substituent are excellent as such compounds to accomplish the present invention.

The present invention provides a toner for developing electrostatic latent images which is characterized in that the toner comprises as a charge control agent a zinc complex compound of an aromatic hydroxycarboxylic acid having or not having a substituent.

Examples of useful aromatic hydroxycarboxylic acids which may have a substituent and which are capable of forming zinc complex compounds are alkyl($C_4$–$C_9$)salicylic acids, 3,5-dialkyl($C_4$–$C_9$)salicylic acids, 2-hydroxy-3-naphthoic acid, alkyl($C_4$–$C_9$)-2-hydroxy-3-naphthoic acids, 5,6,7,8-tetrahalogen-2-hydroxy-3-naphthoic acids, etc.

The zinc complex compound of the present invention can be prepared by dissolving a suitable hydroxycarboxylic acid in water with addition of a sufficient amount of alkali, adding to the solution a metallic zinc giving agent in the agent-to-acid mole ratio of 1:2, heating the mixture, adjusting the pH of the reaction mixture, filtering off the resulting precipitate, thoroughly washing the precipitate with water and drying the precipitate.

Presumably, the product is represented by the formula

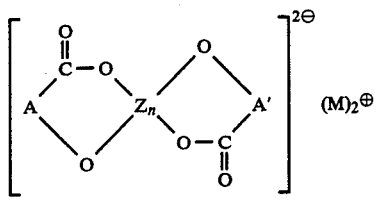

(I)

wherein A and A' are the residue of an aromatic hydroxycarboxylic acid which may have a substituent, and M is a counter ion.

The counter ion can be changed by changing the condition for the aftertreatment of the reaction mixture. For example, when the reaction mixture is adjusted to a pH of up to 3, then filtered and thereafter washed until the pH becomes about 6 to about 7, the counter ion is hydrogen ion. If the pH is adjusted to neutrality to alkalinity with an alkali, alkali metal ion is obtained. Further if the mixture is treated with hydrochlorides of various amines, various ammonium salts are obtained.

The complex compound of the formula (I) is incorporated into a toner generally in an amount of 0.1 to 10 parts by weight, preferably 0.5 to 5 parts by weight, per 100 parts by weight of the component resin of the toner.

The toner of the present invention is prepared by admixing the complex compound of the formula (I) with at least one of the resins heretofore known for use in toners, such as styrene resin, styrene-acrylic resin, styrene-butadiene resin, epoxy resin, polyester resin, paraffin wax and the like. The resin to be used is determined in view of adhering properties, preservability, free-flowability, amenability to pulverization, etc. While a wide variety of known dyes and pigments are usable as coloring agents, especially suitable as coloring agents for toners for color copying are, for example, Benzidine Yellow, quinacridone, Copper Phthalocyanine Blue, Copper Phthalocyanine Green, etc.

Although the toner of the present invention is usually mixed with a carrier to provide a two-component developer, it is of course usable as a one-component developer.

Preparation examples are given below.

PREPARATION EXAMPLE 1

Synthesis of zinc complex compound of 2-hydroxy-3-naphthoic acid

A 42.2 g quantity of 2-hydroxy-3-naphthoic acid (0.22 mole) was completely dissolved in 500 g of 2.7% aqueous solution of caustic soda, and the solution was heated to about 70° C.

Subsequently, 35.5 g (0.13 mole) of zinc sulfate was dissolved in 100 g of water, and the solution was added dropwise to the above solution over a period of 30 minutes. The resulting mixture was maintained at 70° to 80° C. for 2 hours. The mixture was adjusted to a pH of 7.0±0.5, whereupon the reaction was completed. The reaction mixture was filtered hot, and the precipitate was washed with water and dried, giving 47.5 g of a complex compound in the form of pale yellow fine particles. (The complex compound, with Na as counter ion, will hereinafter be referred to as "compound (1)".)

PREPARATION EXAMPLE 2

Synthesis of zinc complex compound of 3,5-di-tert-butylsalicylic acid

A 44.5 g (0.18 mole) quantity of 3,5-di-tert-butylsalicylic acid was completely dissolved in 400 g of 2% aqueous solution of caustic soda, and the solution was heated to about 70° C.

Subsequently, 25.5 g (0.09 mole) of zinc sulfate was dissolved in 100 g of water, and the solution was added dropwise to the above solution over a period of 30 minutes. The mixture was maintained at 70° to 80° C. for 2 hours and then adjusted to a pH of 7.0±0.5 to complete the reaction. The reaction mixture was filtered hot. The precipitate was washed with water and dried, affording 43 g of a complex compound in the form of white fine particles (with Na as counter ion, hereinafter referred to as "compound (2)").

PREPARATION EXAMPLE 3

Synthesis of zinc complex compound of tert-butyl-2-hydroxy-3-naphthoic acid

A 12.2 g (0.05 mole) quantity of tert-butyl-2-hydroxy-3-naphthoic acid was completely dissolved in 200 g of 2% aqueous solution of caustic soda, and the solution was heated to about 70° C. Subsequently, 3.4 g (0.025 mole) of zinc chloride was dissolved in 100 g of water. The solution was added dropwise to the above solution over a period of 30 minutes. The mixture was maintained at 70° to 80° C. for 2 hours and then adjusted to a pH of 7.0±0.5 to complete the reaction. The reaction mixture was filtered hot. The precipitate was washed with water and dried, giving 13.1 g of a complex compound in the form of pale yellow fine particles (with Na as counter ion, hereinafter referred to as "compound (3)").

Examples of the invention are given below, in which the parts are by weight.

EXAMPLE 1

| | |
|---|---|
| Polyester resin (ATR-2010, product of Kao Soap Co., Ltd.) | 100 parts |
| Blue dye (Valifast Blue 2606, product of Orient Chemical Industries, Ltd.) | 2 parts |
| Blue pigment (Copper Phthalocyanine) | 4 parts |
| Compound (1) | 1 part |

The above ingredients were premixed uniformly by a ball mill to obtain a premix, which was kneaded in a molten state by heat rolls, then cooled, thereafter crushed by a vibrating mill and further pulverized by an air jet mill. The fine powder obtained was screened to obtain a blue toner 10 to 20 μm in particle size.

Three parts of the toner was admixed with 97 parts of a carrier of finely divided iron to prepare a developer. The amount of initial blow-off charge on the developer was −28.3 μc/g. When the developer was used for the magnetic brush developing process with a commercial selenium drum, sharp blue toner images were obtained free from fog. Even after the toner was used for continuously making 50,000 copies, no reduction was observed in the quality of copies.

EXAMPLE 2

| | |
|---|---|
| Epoxy resin (Epikote 1004, product of Shell Chemical Co., Ltd.) | 100 parts |
| Carbon black | 6 parts |
| Compound (2) | 2 parts |

The above ingredients were treated in the same manner as in Example 1 to prepare a black toner.

Three parts of the toner obtained was admixed with 97 parts of a carrier of finely divided iron to prepare a developer. The amount of initial blow-off charge on the developer was −24.1 μc/g. When the developer was used for copying in the same manner as in Example 1, sharp black toner images were obtained free from any fog. The toner exhibited no reduction in the quality of copies even after continuously making 50,000 copies.

EXAMPLE 3

| | |
|---|---|
| Styrene-n-butyl methacrylate copolymer resin (65/35) | 100 parts |
| C.I. Solvent Yellow 77 | 6 parts |
| Compound (1) | |

The above ingredients were treated in the same manner as in Example 1 to prepare a yellow toner.

Three parts of the toner obtained was admixed with 97 parts of a carrier of finely divided iron to prepare a developer. The amount of initial blow-off charge on the developer was −25.2 μc/g. When used for copying in the same manner as in Example 1, the developer produced toner images free from any fog and outstanding in reproducibility of thin lines. The toner exhibited no reduction in the quality of copies even after continuously making 50,000 copies.

EXAMPLE 4

| | |
|---|---|
| Styrene-n-butyl methacrylate copolymer resin (65/35) | 100 parts |
| Red dye (Valifast Pink 2310, product of | 8 parts |

-continued

| | |
|---|---|
| Orient Chemical Industries, Ltd.) | |
| Compound (2) | 2 parts |

A red toner was prepared from the above ingredients in the same manner as in Example 1.

Three parts of the toner obtained was admixed with 97 parts of a carrier of finely divided iron to obtain a developer. The amount of initial blow-off charge on the developer was −22.9 μc/g. When used for copying in the same manner as in Example 1, the developer produced sharp red toner images free from any fog. The toner exhibited no reduction in the quality of copies even after continuously making 50,000 copies.

EXAMPLE 5

| | |
|---|---|
| Styrene-n-butyl methacrylate copolymer resin (65/35) | 100 parts |
| C.I. Solvent Yellow 77 | 6 parts |
| Compound (3) | |

A yellow toner was prepared from the above ingredients in the same manner as in Example 1.

Three parts of the toner obtained was admixed with 97 parts of a carrier of finely divided iron to obtain a developer. The amount of initial blow-off charge on the developer was −21.8 μm/g. When used for copying in the same manner as in Example 1, the developer produced sharp yellow toner images free from any fog. The toner exhibited no reduction in the quality of copies even after continuously making 50,000 copies.

What is claimed is:

1. A toner for developing electrostatic latent images characterized in that the toner comprises as a charge control agent a zinc complex compound of a hydroxy-naphthoic acid having or not having a substituent.

2. A toner as defined in claim 1 which comprises a resin component and 0.5 to 5 parts by weight of the zinc complex compound per 100 parts by weight of the resin component of the toner.

3. A toner as defined in claim 1 wherein the zinc complex compound has the formula:

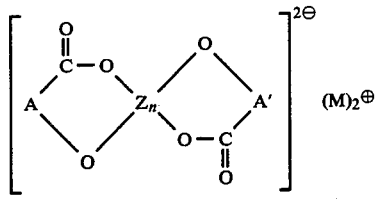

(I)

wherein A and A′ are the residue of a hydroxy-naphthoic acid, and M is one of a hydrogen ion, an alkali metal ion, and an ammonium ion.

4. A toner as defined in claim 1 wherein the hydroxy-naphthoic acid is selected from the group consisting of 2-hydroxy-3-naphthoic acid, and alkyl ($C_4$–$C_9$)-2-hydroxy-3-naphthoic acids, 5, 6, 7, 8-tetrahalogen-2-hydroxy-3-naphthoic acids.

5. A toner as defined in claim 4 including a resin component, there being 0.5 to 5 parts by weight of the zinc complex compound per 100 parts by weight of the resin component.

6. A toner as defined in claim 4 wherein the hydroxy-naphthoic acid is tert.-butyl-2-hydroxy-3-naphthoic acid.

7. A toner as defined in claim 4 wherein the hydroxy-naphthoic acid is 2-hydroxy-3-naphthoic acid.

8. Toner for developing electrostatic latent images comprising as a charge control agent a zinc complex compund of an aromatic hydroxy-carboxylic acid having or not having a substituent, the zinc complex compound being present in admixture with a resin component selected from the group consisting of styrene resin, styrene-acrylic resin, styrene-butadiene resin, apoxy resin, and paraffin wax.

9. Toner of claim 8 wherein the zinc complex compound has the formula:

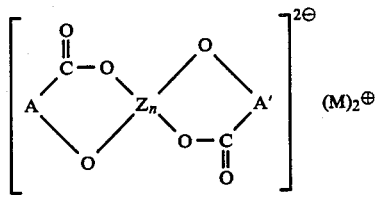

(I)

wherein A and A′ are the residue of an aromatic hydroxy-carboxylic acid, and N is selected from the group consisting of a hydrogen ion, an alkali metal ion, and an ammonium ion.

10. Toner of claim 8 wherein the acid is selected from the group consisting of alkyl ($C_4$–$C_9$) salicylic acids, 3,5-dialkyl ($C_4$–$C_9$) salicylic acids, 2-hydroxy-3-naphthoic acid, alkyl ($C_4$–$C_9$)-2-hydroxy-3-naphthoic acids, and 5,6,7,8-tetrahalogen-2-hydroxy-3-naphthoic acids.

11. Toner of claim 10 wherein the acid is 3,5-di-tert.-butyl-salicylic acid.

12. Toner of claim 10 wherein the acid is tert.-butyl-2-hydroxy-3-naphthoic acid.

13. Toner of claim 10 wherein the acid is 2-hydroxy-3-naphthoic acid.

* * * * *